US009920644B2

(12) United States Patent
McKenna

(10) Patent No.: US 9,920,644 B2
(45) Date of Patent: Mar. 20, 2018

(54) RIFFLED SEAL FOR A TURBOMACHINE, TURBOMACHINE AND METHOD OF MANUFACTURING A RIFFLED SEAL FOR A TURBOMACHINE

(71) Applicant: Siemens Aktiengesellschaft, Munich (DE)

(72) Inventor: Mike McKenna, Newark (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 324 days.

(21) Appl. No.: 14/767,341

(22) PCT Filed: Jan. 23, 2014

(86) PCT No.: PCT/EP2014/051291
§ 371 (c)(1),
(2) Date: Aug. 12, 2015

(87) PCT Pub. No.: WO2014/127954
PCT Pub. Date: Aug. 28, 2014

(65) Prior Publication Data

US 2016/0017740 A1 Jan. 21, 2016

(30) Foreign Application Priority Data

Feb. 20, 2013 (EP) ..... 13155933
Apr. 10, 2013 (EP) ..... 13163164

(51) Int. Cl.
*F01D 9/04* (2006.01)
*F01D 11/00* (2006.01)
(Continued)

(52) U.S. Cl.
CPC ..... *F01D 11/008* (2013.01); *F01D 5/12* (2013.01); *F01D 9/041* (2013.01); *F01D 11/005* (2013.01);
(Continued)

(58) Field of Classification Search
CPC ..... F01D 11/008; F01D 5/12; F01D 9/041; F01D 11/005; F01D 11/006; F01D 11/02;
(Continued)

(56) References Cited

U.S. PATENT DOCUMENTS 3,100,358 A 8/1963 Robinson, Jr.
5,221,096 A * 6/1993 Heldreth ..... F01D 11/005 277/630
(Continued)

FOREIGN PATENT DOCUMENTS

CA 2230217 A1 9/1998
DE 19814442 A1 10/1998
(Continued)

*Primary Examiner* — Mark Laurenzi
*Assistant Examiner* — Shafiq Mian
(74) *Attorney, Agent, or Firm* — Beusse Wolter Sanks & Maire

(57) ABSTRACT

A seal of a turbomachine reduces a leakage flow between a first and second component of the turbomachine. The first component has a first surface and the second component has a second surface, wherein the first component is stiff with regard to a first force exerted perpendicularly thereto and the second component is stiff with regard to a second force exerted perpendicularly thereto. The first surface is opposite the second surface, together defining boundaries of a fluid passage for the leakage flow. The first surface has a first surface riffle. A turbomachine has a seal described above, wherein the turbomachine is a gas turbine engine. A method of manufacturing a first component of a turbomachine with a reduced leakage flow between the first component and a second component of the turbomachine includes fabrication
(Continued)

of a first surface riffle, in particular by grinding and/or by electrical discharge machining.

17 Claims, 5 Drawing Sheets

(51) Int. Cl.
*F01D 11/02* (2006.01)
*F01D 5/12* (2006.01)

(52) U.S. Cl.
CPC ..... *F01D 11/006* (2013.01); *F01D 11/02* (2013.01); *F05D 2220/32* (2013.01); *F05D 2240/12* (2013.01); *F05D 2240/30* (2013.01); *F05D 2240/55* (2013.01); *F05D 2240/57* (2013.01); *F05D 2240/80* (2013.01); *F05D 2250/294* (2013.01); *F05D 2250/611* (2013.01)

(58) Field of Classification Search
CPC ..... F05D 2220/32; F05D 2240/12; F05D 2240/30; F05D 2240/55; F05D 2240/57; F05D 2240/80; F05D 2250/294; F05D 2250/611
See application file for complete search history.

(56) References Cited

U.S. PATENT DOCUMENTS 5,374,068 A * 12/1994 Jewett ..... F16J 15/441 277/303
5,865,600 A * 2/1999 Mori ..... F01D 11/005 277/643
6,149,387 A * 11/2000 Chikami ..... F01D 11/003 416/198 A
7,384,235 B2 * 6/2008 Adis ..... F01D 11/001 277/413
7,704,041 B2 * 4/2010 Adis ..... F01D 11/003 277/413
8,201,834 B1 6/2012 Liang
9,399,926 B2 * 7/2016 Wiebe ..... F01D 11/08
9,587,746 B2 * 3/2017 Bidkar ..... F01D 11/025
9,598,971 B2 * 3/2017 Hasnedl ..... F01D 11/12
9,726,028 B2 * 8/2017 Marra ..... F01D 9/042
2005/0100439 A1 5/2005 Greim et al.
2007/0114727 A1 * 5/2007 Greif ..... F01D 11/001 277/355
2009/0160135 A1 6/2009 Turini et al.
2012/0027582 A1 * 2/2012 Natarajan ..... F01D 11/025 415/229
2013/0207351 A1 8/2013 Milazar

FOREIGN PATENT DOCUMENTS

EP 0919701 A1 6/1999
EP 1515000 A1 3/2005
EP 2407641 A1 1/2012
GB 2447892 A 10/2008
RU 2127388 C1 3/1999

* cited by examiner

RIFFLED SEAL FOR A TURBOMACHINE, TURBOMACHINE AND METHOD OF MANUFACTURING A RIFFLED SEAL FOR A TURBOMACHINE

CROSS REFERENCE TO RELATED APPLICATIONS

This application is the US National Stage of International Application No. PCT/EP2014/051291 filed Jan. 23, 2014, and claims the benefit thereof. The International Application claims the benefit of European Application Nos. EP13155933 filed 20 Feb. 2013 and EP13163164 filed 10 Apr. 2013. All of the applications are incorporated by reference herein in their entirety.

FIELD OF INVENTION

The present invention relates to a seal between two components of a turbomachine. In other words, it relates to a reduction of a leakage flow between two components of a turbomachine. Furthermore, it relates to a turbomachine with such a seal and a method of manufacturing the seal.

BACKGROUND OF THE INVENTION

A gas path of a turbomachine is typically segmented in several sections. Between two adjacent sections, a gap usually exists. This is due to the fact that components of a turbomachine experience large temperature differences: In stand-by state, i.e. when the turbomachine stands still, temperature of the components of the turbomachine typically is around room temperature, while in operation, i.e. during rotation, the components bordering the gas path are in direct contact with a gas, which, e.g. in case of a gas turbine engine, easily can achieve a temperature of several hundred degree Celsius and can approach e.g. up to 1600 degree Celsius. A consequence of these temperature differences is an expansion of the components during operation compared to the stand-by state.

Therefore, components of the turbomachine that experience large temperature differences are typically arranged such that in stand-by state of the turbomachine a certain gap between adjacent components exist. This allows an expansion of these components during operation and high temperatures without damaging the assembled turbomachine.

However, an adverse consequence is a potential ingress of a gas, a fluid and/or particles from cavities surrounding the gas path via these gaps. Alternatively, also working gas, i.e. gas from the gas path, may escape or egress into these cavities. This undesired ingress or egress of the gas, the fluid and/or particles is referred to as a leakage flow.

Thus, various methods have been investigated and applied in order to seal the gap between two adjacent components of the turbomachine. One way is the application of a typically thin strip of material, a so-called seal strip, which is captivated in a pair of slots or groves in a pair of mating faces of two adjacent components. The seal strip creates a tortuous leak path that reduces the leakage flow.

However, there exist structures of a turbomachine where the application of a seal strip is difficult or not even possible. Furthermore, there also exists the case where the application of a seal strip reduces the leakage flow to a certain extent, but a further reduction of the leakage flow is needed.

Therefore, there exists the need of an improved seal of a turbomachine for reducing the leakage flow between two adjacent components of the turbomachine further.

SUMMARY OF THE INVENTION

This objective is achieved by the independent claims. The dependent claims describe advantageous developments and modifications of the invention.

In accordance with the invention there is provided a seal of a turbomachine for reducing a leakage flow between a first component of the turbomachine and a second component of the turbomachine. The seal comprises the first component with a first surface and the second component with a second surface The first component is stiff with regard to a first force exerted perpendicularly to the first surface and the second component is stiff with regard to a second force exerted perpendicularly to the second surface. Furthermore, the first surface is opposite to the second surface. In particular the first surface and the second surface define boundaries of a fluid passage for the leakage flow. The first surface comprises a first surface riffle.

The fluid passage may be defined by opposing walls of the first and second components. The fluid passage may be defined by at least one groove in one or both the first and second components. The fluid passage may be a gap or defined by spaced apart first and second components. The fluid passage is advantageously arranged in a radial direction, that is to say, the walls of the components defining the fluid passage are substantially radially aligned. However, the fluid passage may be angled with from a radial line or plane.

The riffle on any one or more of the first or second component may be any one of a series of grooves, notches, undulations or corrugations. The depth and spacing of the riffle may vary and may depend on or be optimised for the leakage flow characteristics. For example, the spacing and/or depth may be varied across the riffle to perform optimally with both high and low quantities and velocities of leakage flows. Varying leakage flows may occur due to different operating points of the engine and different pressure differentials across the fluid passage. The width of the fluid passage may also vary depending on operational speeds of the engine and rotor.

The riffle may be straight or arcuate. The riffle may be aligned or parallel with an engine or rotor axis.

Alternatively, the riffle may be angled relatively to the engine axis. The riffle may be angled such that the grooves, notches, undulations or corrugations are generally perpendicular to the flow of leakage air through the fluid passage.

The turbomachine as a whole may comprise a plurality of components. The first component and the second component may be adjacent to each other. Both components may partially or completely be in direct contact and/or indirect contact with each other. The contact between the first component and the second component may be permanent or temporary. There may for example be no direct contact between both components in stand-by state and low temperature, e.g. ambient temperature, but both components may get into contact at high temperatures, e.g. at temperatures of several hundred degree Celsius approaching 1600 degree Celsius.

The leakage flow comprises a gas, a liquid, particles and/or a combination thereof in a multi phase fluid.

The first component, the second component and any further component comprised by the turbomachine will in the following also denoted simply as a component. The first surface, the second surface and any further surface comprised by a component will in the following also denoted simply as a surface. The first surface riffle and any further surface riffles will in the following also denoted simply as a surface riffle.

The first surface, which is a part of the surface of the first component, is opposite to the second surface, which is a part of the surface of the second component. Both surfaces may be substantially parallel to each other.

The leakage flow that shall be reduced by the seal flows along the first surface and the second surface. In other words, it flows through a section confined by the first surface and the second surface. As the leakage flow shall be minimised, it is advantageous to minimise a distance between the first surface and the second surface, which is called a surface distance.

The surface distance may vary due to thermal expansion of the components, as already mentioned above. The surface distance furthermore depends on the size of the components and the materials they are made of—the latter one determining a coefficient of thermal expansion. However, in a further embodiment, the surface distance is below 2 mm (millimeter), in particular below 1 mm, during operation of the turbomachine; in stand-by state the surface distance is below 5 mm, in particular below 3 mm.

The first surface is opposite to the second surface, which means that the first surface is facing the second surface in an unobstructed view.

The first component is stiff with regard to a first force exerted perpendicularly to the first surface. The first component may, however, be flexible with regard to another force exerted to another surface section of the first component. The first component does not comply substantially when the first force acts on the first surface. Analogously, the second component is stiff with regard to a second force exerted perpendicularly to the second surface.

In particular the component is completely stiff with regard to any force exerted to any surface of the component. A "stiff component" in this patent application means that the component is rigid, unpliable and not deformable. The component does for example not comply with a seal strip, by comparison. In other words, the first component and the second component are substantially equal in strength or elasticity. Thus, a seal strip, for instance, shall not be considered as a component in the context of this application.

A material may deform, under a certain load, elastically, plastically or may even disintegrate. The expression "stiff component" should be seen in a context of neighbouring or adjacent components that the component interacts with directly or indirectly.

An important feature of the seal according to the invention is the first surface riffle, which is comprised by the first surface. The goal of a surface riffle is to further reduce the leakage flow passing by, i.e. passing along the surface riffle. This reduction in leakage is achieved by avoiding a straight through leak path, but replaces it by a more tortuous path. Thus a riffled surface discourages and reduces the leakage flow.

A riffle is in particular a surface with a certain surface structure comprising ridges and depressions.

The invention is directed to any seal of a turbomachine—particularly of a gas turbine engine—where a leakage flow between two adjacent components shall be reduced.

Applications may in particular be in rotor blades, stator vanes, heat shield segments, combustion liners, tip seal segments and interstage seals.

In a first embodiment, the first surface riffle may comprise a plurality of notches.

A notch can also be labelled an indentation or a groove. A notch is characterised by a notch depth, a notch width and, in a three-dimensional view, a notch length. In a cross-sectional view, i.e. only considering the notch depth and the notch width, the notch may e.g. comprise a shape of a half circle or a half ellipse, i.e. a U-shape, a shape of a triangle, i.e. a V-shape, a shape of a rectangle or a shape a trapezium. Obviously, also other shapes which cannot be described by a simple geometrical term are possible.

To significantly influence the leakage path of the leakage flow a plurality of notches may be comprised by the first surface riffle. The notches may be adjacent to each other. Alternatively, there may also be a space between two neighbouring notches.

The plurality of notches may consist of notches, wherein each notch of the plurality of notches features a same or a similar shape. Alternatively, the plurality of notches may also consist of notches, wherein a first notch has a first shape, a second notch has a second shape and the first shape differs from the second shape.

The dimensions of a notch depend inter alia on the size of the component as well as on the surface distance. In a further embodiment, the notch depth may be in a range between 0.25 mm and 7 mm, in particular in a range between 0.75 mm and 4 mm. The notch width is advantageously in a range between 0.25 mm and 5 mm, in particular in a range between 0.75 mm and 3 mm. In a specific embodiment, the notch depth is in the range between 1 mm and 3 mm and the notch width is in the range of 1 mm and 2 mm.

Lateral extension and lateral shape of the notch also have an impact on the reduction of the leakage flow. The lateral extension is referred to as the notch length, while the lateral shape describes whether the notch is e.g. a straight line or whether it is curved. It may be beneficial to choose a notch length which is slightly smaller than the lateral extension of the surface where the surface riffle is applied to. A surface riffle which stops shortly before the end of the component has the advantage of preventing extra leak paths, e.g. an extra leak path of leakage flow that ingress on one side of the component, flows along a notch and escapes at the other side of the component.

The choice of the lateral shape of a notch depends on the shape of the component. If the component has e.g. a shape of a semicircle in a cross-sectional view along the notch length, a curved lateral shape is advantageous. The choice of the lateral shape also depends on effort of manufacture.

Regarding this issue, a straight line may be advantageous compared to e.g. a wave shape.

A turbomachine may comprise a turbomachine rotor. The turbomachine rotor may comprise a plurality of blades, a rotor disc and a rotor axis. In this case, the axis of rotation of the turbomachine may coincide with the rotor axis. The first component and the second component may be located on the periphery of the rotor disc and circumferentially spaced one to each other. Then, the fluid passage between both components where the leakage flow flows through may point in a direction which is radially extending from the axis of rotation.

Thus, when the first component and the second component are installed in the turbomachine, in a further embodiment the turbomachine may comprise an axis of rotation and the first surface and the second surface are radially extending from the axis of rotation, or the first surface and the second surface are substantially extending parallel to the axis of rotation.

Surfaces which substantially extend parallel to the axis of rotation relate to a situation where, for instance, a leakage flow between a vane carrier or casing and a nozzle guide vane segment lug or rail at an outer end is reduced. Furthermore, an application would be advantageous for a heat shield, as a hook or a rail is normally designed similarly.

Depending on the configuration of the turbomachine, a further surface riffle may be beneficial.

Thus, in another embodiment, the first component may comprise a third surface and the second component comprises a fourth surface. The third surface is opposite to the fourth surface. The second surface comprises a second surface riffle, the third surface comprises a third surface riffle and/or the fourth surface comprises a fourth surface riffle.

If the seal comprises two surface riffles (instead of three or four surface riffles), it may be beneficial from a manufacturing point of view that the two surface riffles are comprised by the same component. In other words, it may be beneficial if the first component comprises a first surface riffle and a third surface riffle or if the second component comprises a second surface riffle and a fourth surface riffle.

As it has been mentioned already, a function of a surface riffle is to create a tortuous leakage path. Depending on a density, or in a non-physical terminology on intensity, of the leakage flow, it may be beneficial to apply a surface riffle on both surfaces opposite to each other. Furthermore, if e.g. the leak path is relatively long, it may be beneficial to have a further surface section with a riffled surface.

In a further embodiment, the second surface may be substantially parallel to the third surface and the fourth surface.

The seal may for example reduce a leakage flow between two adjacent components that are joined with a mortise and tenon joint. A mortise and tenon joint comprises a mortise hole and a tenon. The tenon, formed on the end of a member generally referred to as a rail, may be inserted into e.g. a rectangular cuboid hole cut into a corresponding member, the mortise. Given this configuration, it may be beneficial to incorporate one riffled surface section, i.e. the first surface riffle and/or the second surface riffle, on one side of the tenon and incorporate, opposite and parallel on the other side of the tenon, another riffled surface section comprising the third surface riffle and/or the fourth surface riffle.

In a further embodiment, the leakage flow may be diverted by a diversion angle of greater than 135 degree between the first surface riffle and the third surface riffle and/or between the first surface riffle and the fourth surface riffle.

In particular, the diversion angle comprises substantially 180 degree. Given the example of a mortise and tenon joint described above, this would imply that the tenon has a shape of a rectangular cuboid.

A large diversion angle in general has the consequence that the leakage flow is redirected or deflected strongly, which may reduce the leakage flow itself significantly, compared to the case that the leakage flow runs straightly. Therefore, a large diversion angle of the leakage flow may be very beneficial for the seal.

In another embodiment, the seal comprises a leakage flow access side, a leakage flow exit side and a seal strip with a horizontal seal strip extension and a vertical seal strip extension. A direction of a differential pressure between the leakage flow access side and the leakage flow exit side is substantially perpendicular to the horizontal seal strip extension.

The horizontal seal strip extension and the vertical seal strip extension may comprise an angle of substantially 90 degree.

Furthermore, the seal strip comprises a lateral seal strip extension.

A goal of the seal strip is to significantly further reduce the leakage flow of the seal.

A seal strip may have a flat shape, which means that the horizontal seal strip extension is at least one order of magnitude greater than the vertical seal strip extension. In particular, a ratio between the horizontal seal strip extension and the vertical seal strip extension may be greater than 50, in particular greater than 100. Also the lateral seal strip extension is at least one order of magnitude greater than the vertical seal strip extension. In particular, a ratio between the lateral seal strip extension and the vertical seal strip extension may be greater than 50, in particular greater than 100.

A seal strip may be flexible, i.e. pliable, with regard to a force that is exerted perpendicularly to the horizontal seal strip extension. With regard to another force that is exerted perpendicularly to the vertical seal strip extension, the seal strip may be flexible or stiff.

It is beneficial that the seal strip is less stiff, i.e. more flexible, than the neighbouring components. In other words, it is beneficial if the seal strip complies when loaded by a stiffer structure, such as e.g. a thermally growing vane segment.

The seal strip may be partly in contact with the first component and/or the second component. The seal strip may be temporarily in contact with one or both of the components.

Given a turbomachine with an axis of rotation, the horizontal seal strip extension may be perpendicularly to a line through the axis of rotation and the horizontal seal strip extension.

In stand-by state, a direct contact may exist between parts of a lower horizontal surface of the seal strip, the lower horizontal surface being defined as a surface of the seal strip which is directed towards the axis of rotation of the turbomachine. During rotation of the turbomachine a centrifugal force applies on the seal strip pushing the seal strip away from the axis of rotation. Therefore, during rotation, a direct contact may exist between parts of an upper horizontal surface of the seal strip, the upper horizontal surface being defined as a surface of the seal strip which is directed opposite to the axis of rotation.

A seal strip may itself have a riffled surface section to reduce the leakage flow, e.g. during operation.

It shall be stressed, that a seal strip is a beneficial embodiment, though not a mandatory feature, for the invention.

A side or section of the seal where the leakage flow ingresses, i.e. entries or accesses to or flows into, the surface distance is called the leakage flow access side. The leakage flow access side may be part of or adjacent to a cavity.

A side or section of the seal where the leakage flow escapes or exits the surface distance is called the leakage flow exit side. The leakage flow exit side may be part of or adjacent to a cavity, too.

The differential pressure between the leakage flow access side and the leakage flow exit side is defined as the difference between a first pressure at the leakage flow access side and a second pressure at the leakage flow exit side. If the first pressure is greater than the second pressure, the direction of the differential pressure points from the leakage flow access side to the leakage flow exit side. Analogously, if the first pressure is smaller than the second pressure, the direction of the differential pressure points from the leakage flow exit side to the leakage flow access side.

Exemplarily, in a turbomachine with a gas path—i.e. a main fluid path—section, a radially inner section and two components separated by a fluid passage which has to be sealed, there may be, in a first operation mode of the turbomachine, a differential pressure from the gas path section to the radially inner section, i.e. the seal reduces ingress of gases from the gas path to the radially inner section. However, in a second operation mode of the turbomachine, there may be a differential pressure from the radially inner section to the gas path section, i.e. the seal minimises an escape of gases from the radially inner section to the gas path.

It is beneficial to place the seal strip, i.e. the horizontal seal strip extension, substantially perpendicularly to the direction of the differential pressure. "Substantially perpendicular" comprises a range from 80 degree to 100 degree, in particular a range from 85 degree to 95 degree. A first advantage of a substantially perpendicularly placed seal strip is the large diversion angle of the leakage flow. In this example, the leakage flow is first diverted by 90 degree, subsequently it is diverted by 180 degree and finally it is diverted again by 90 degree.

Another advantage of the seal strip is the possibility of defining only a relatively small fluid passage between the surface of the component and the surface of the seal strip. Obviously, thermal expansion of the component and the seal strip during operation should be considered.

In another embodiment, the first component is a rotatable part and/or a static part of the turbomachine, and the second component is a rotatable part and/or a static part of the turbomachine.

In this context, a static part of a turbomachine relates to a non-rotating part during operation of the turbomachine.

In a further embodiment, the first component and the second component are both part of a turbine blade or the first component and the second component are both part of a stator vane.

In a further embodiment, the first component may be a first part of a first turbine blade and the second component may be a second part of the first turbine blade. Alternatively, the second component may also be the second part of a second turbine blade.

Analogously, the first component may be a first part of a first stator vane and the second component may be a second part of the first stator vane. Alternatively, the second component may also be the second part of a second stator vane.

Furthermore, the invention is also directed towards a turbomachine comprising a seal as described above, wherein the turbomachine is a gas turbine engine.

A turbomachine is a machine that transfers energy between a rotor and a fluid. More specifically, it transfers energy between a rotational movement of a rotor and a lateral flow of a fluid. A first type of a turbomachine is a turbine, e.g. a turbine section of a gas turbine engine. A turbine transfers energy from a fluid to a rotor. A second type of a turbomachine is a compressor, e.g. a compressor section of a gas turbine engine. A compressor transfers energy from a rotor to a fluid.

A gas turbine engine can e.g. be used in aviation, passenger surface vehicles, ships, as mechanical drive, e.g. to drive a pump or a compressor transporting a fluid or being coupled to an electrical generator to produce electricity.

In a further embodiment, the seal is located in a gas turbine section of the turbomachine and/or in a compressor section of the turbomachine.

A last aspect of the invention relates to a method of manufacturing a first component of a turbomachine with a reduced leakage flow between the first component and a second component of the turbomachine. The first component comprises a first surface and the second component comprises a second surface. The first surface is opposite to the second surface. In particular, the first surface and the second surface define boundaries of a fluid passage for the leakage flow. The method comprises fabrication of a first surface riffle, in particular by grinding and/or by electrical discharge machining.

Grinding has to be understood as an abrasive machining process that uses e.g. a grinding wheel as a cutting tool.

Electric discharge machining (EDM), which is also referred to as spark machining, spark eroding, burning, die sinking or wire erosion, is a manufacturing process whereby a desired shape is obtained using electrical discharges, i.e. sparks.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematically. It is noted that for similar or identical elements in different figures, the same reference signs will be used.

DETAILED DESCRIPTION OF THE DRAWINGS

Figure 1:
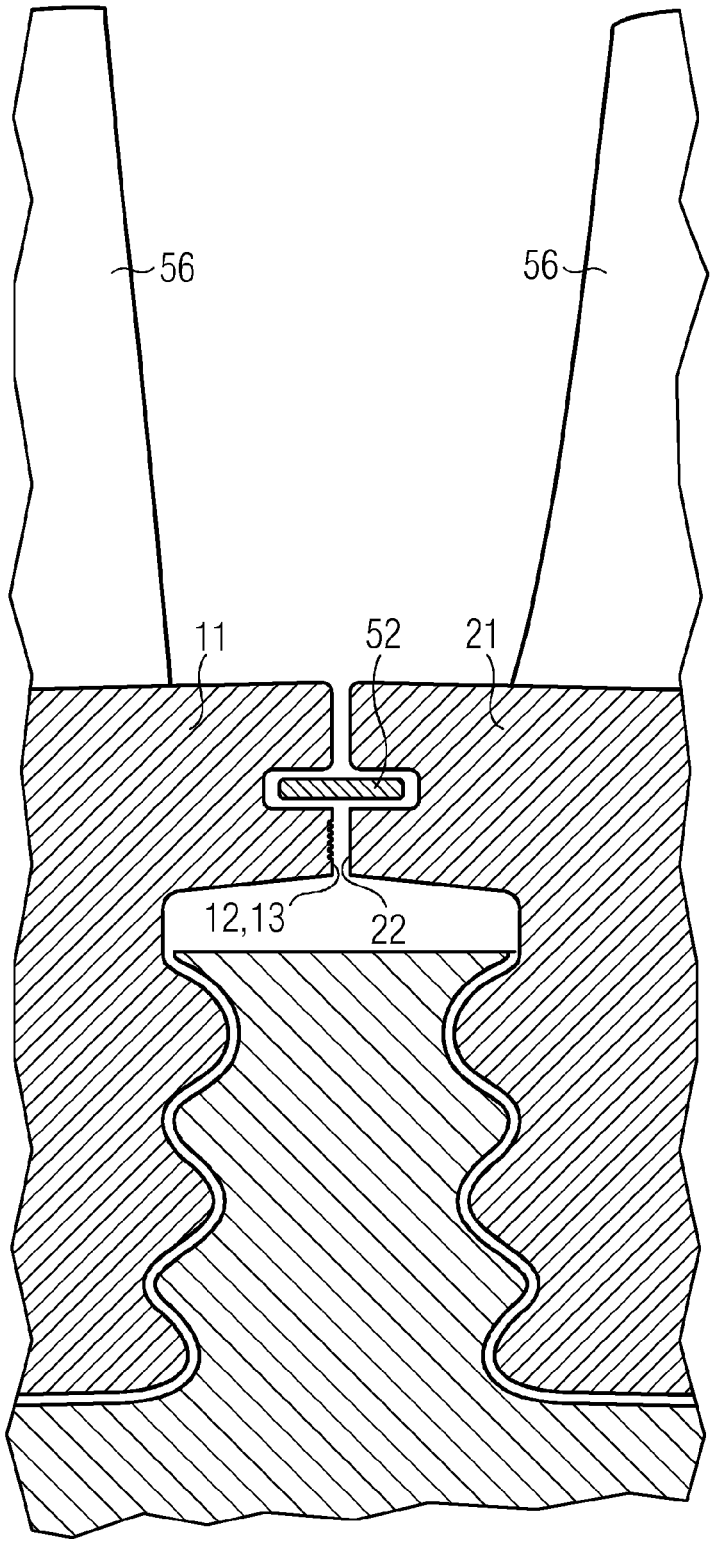
FIG. 1: shows a riffled seal of a turbomachine and parts of the turbomachine in a cross-sectional view.

Referring to FIG. 1, a riffled seal of a turbomachine and parts of the turbomachine in a cross-sectional view in a plane perpendicularly to an axis of rotation 66 of the turbomachine are shown. Exemplarily, parts of rotor blades and parts of a rotor disc are illustrated. A first component 11 of the turbomachine comprises a firtree-shaped root and a platform. An aerofoil 56 is joined with the first component 11. Next to the first component 11, a second component 21 of the turbomachine is located. The second component 21 similarly comprises a firtree-shaped root and a platform.

Also an aerofoil 56 is joined with the second component 21. The first component 11 and the second component 21 are separated by a fluid passage. A part of the surface of the first component 11 is denoted by a first surface 12. The first surface 12 comprises a first surface riffle 13.

Opposite to the first surface 12 a second surface 22 is located. Finally, the seal shown in FIG. 1 also comprises a seal strip 52, which is located in a pair of slots—each in one of the roots or platforms—perpendicularly to a direction of a differential pressure.

It should be noted that this invention is independent to the seal strip 52 and its slots. The invention can be used in a serial arrangement, upstream or downstream of the conventional seal strip 52 to improve the sealing performance or it may be used on its own with no seal strip 52 present at all.

Figure 2:
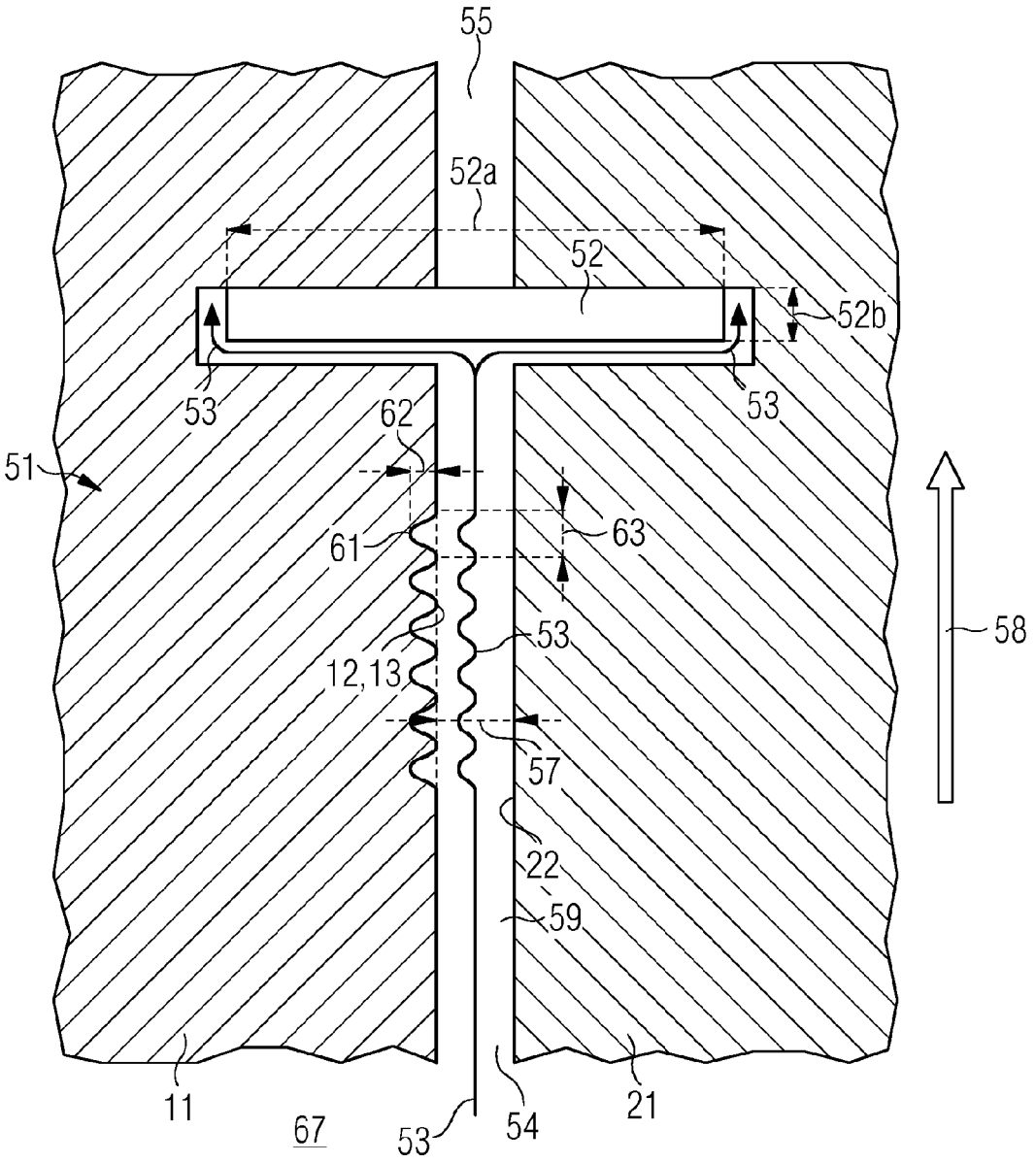
FIG. 2: shows a riffled seal in a cross-sectional view.

In FIG. 2 a riffled seal 51 according to the invention is exemplarily shown in a cross-sectional view in more detail. The seal 51 comprises again a first component 11 of a turbomachine with a first surface 12 and a second component 21 of a turbomachine with a second surface 22. The first surface 12 comprises a first surface riffle 13. The first surface riffle 13 comprises a plurality of notches. One of the plurality of notches—identified as notch 61—is characterised by a notch depth 62 and a notch width 63. In FIG. 2, the plurality of notches comprises notches which feature a round, curved shape.

The first surface 12 and the second surface 22 are separated by a fluid passage 59 which width is denoted by a surface distance 57. Furthermore, the seal 51 comprises a leakage flow access side 54 and a leakage flow exit side 55, defining thus a direction 58 of a differential pressure. As an example, in FIG. 2 a gas path of the turbomachine is conducted at the leakage flow exit side 55 in the upper part of the drawing, whereas in the lower part of the drawing, at the leakage flow access side 54, a radially inner section with a cavity 67 is situated. Therefore, the seal 51 reduces an undesired ingress of gases from the inner section into the gas path via the fluid passage 59 between the first component 11 and the second component 21. More specifically, a leakage flow 53 is diverted, deflected and slowed down in a region of the first surface riffle 13. Thus a tortuous leakage flow 53 in that region results, leading to an overall reduction of the leakage flow 53.

FIG. 2 additionally shows another feature to reduce the leakage flow 53. A seal strip 52, comprising a horizontal seal strip extension 52*a* and a vertical seal strip extension 52*b*, is introduced into a leak path of the leakage flow 53. The leakage flow 53 is thus split into two fractions and guided along a number of edges.

Figure 3:
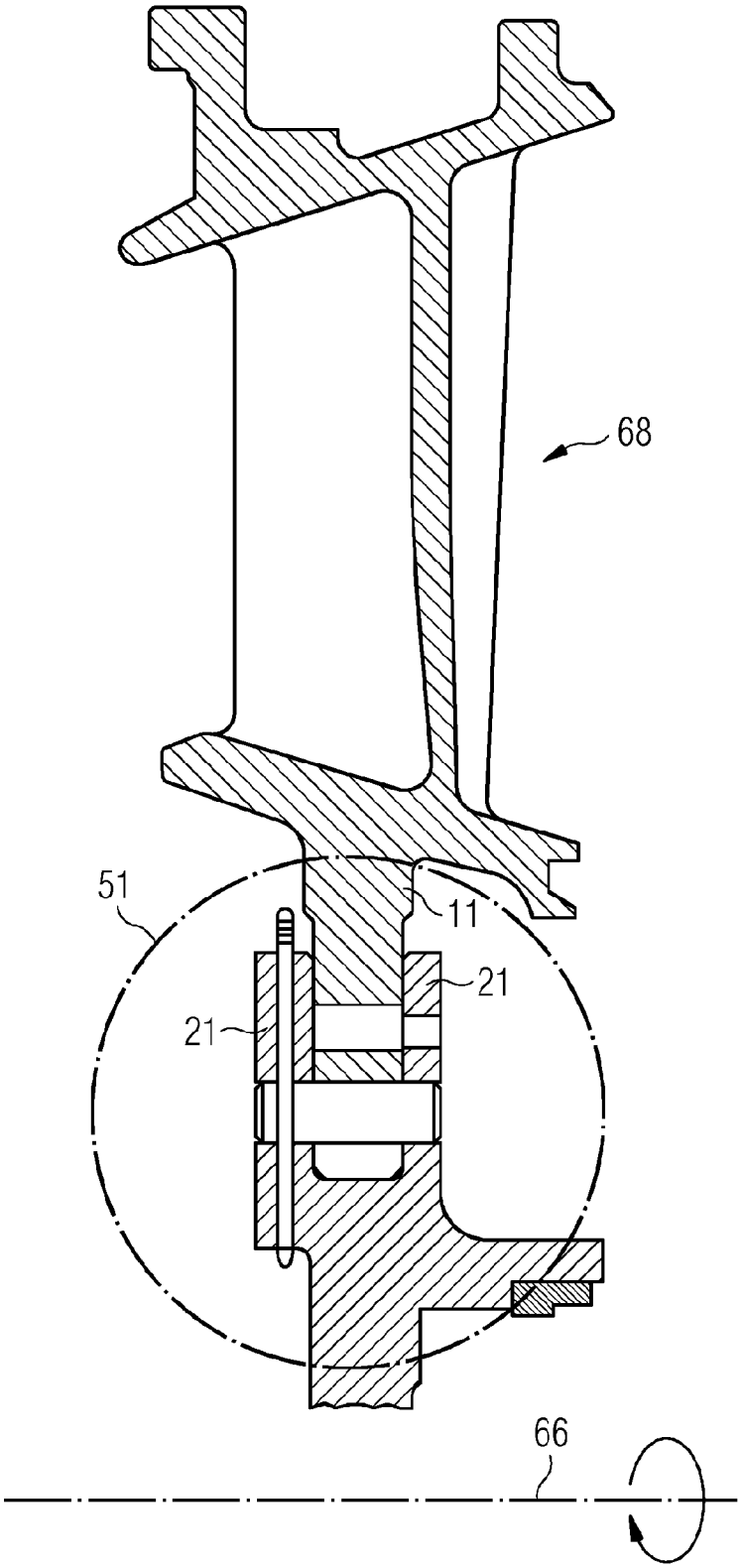
FIG. 3: shows a seal and parts of a nozzle segment in a cross-sectional view.

FIG. 3 shows a seal 51 and parts of a nozzle segment in a cross-sectional view in a plane through an axis of rotation 66 of a turbomachine. A stator vane 68 with a mortise and tenon joint can be identified. The tenon refers to a first component 11 of the turbomachine, the mortise to a second component 21.

Figure 4:
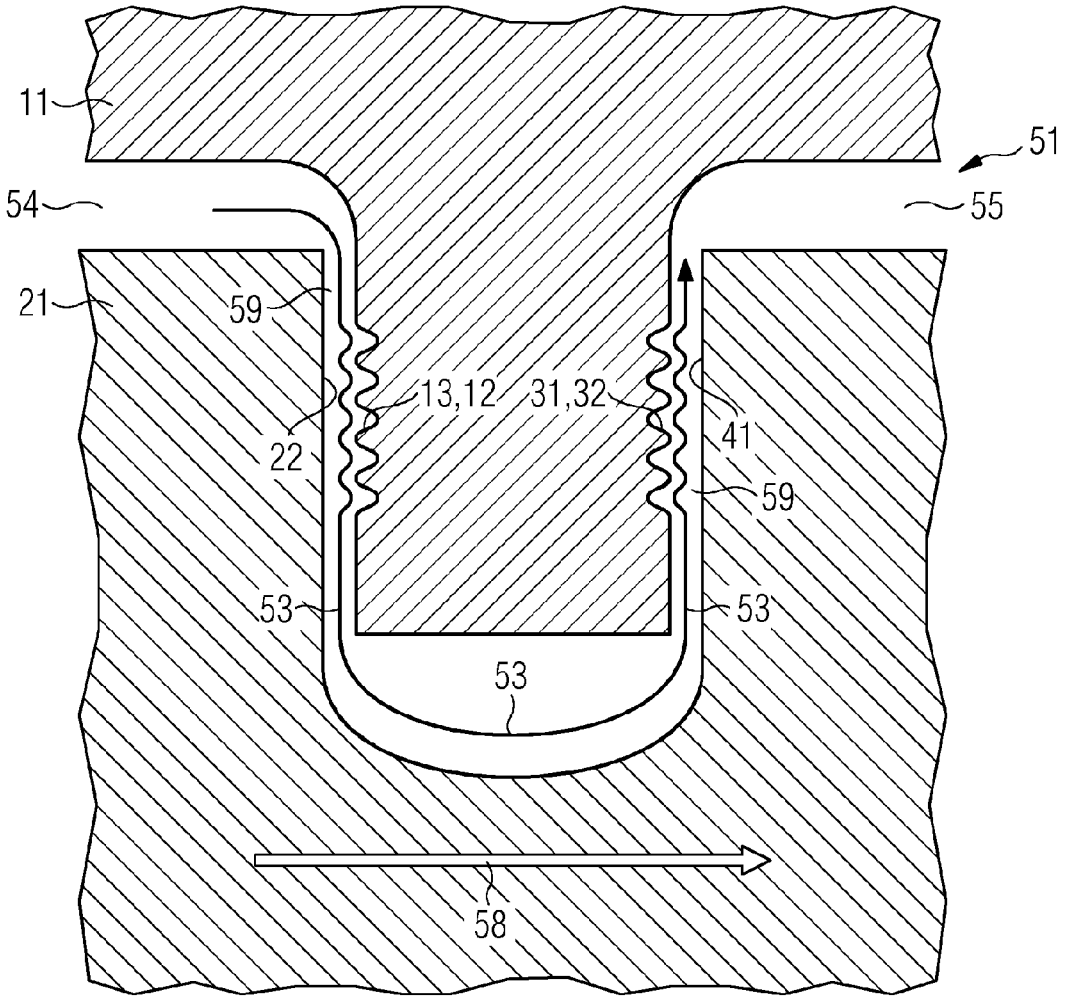
FIG. 4: shows a mortise and tenon joint with a riffled seal in a cross-sectional view.

FIG. 4 shows a mortise and tenon joint with a riffled seal 51 in more detail. The tenon is also referred to as a lug or a rail, particularly for an interface between a guide vane and a guide carrier. In FIG. 4, the tenon refers to a first component 11 of a turbomachine, the mortise to a second component 21. In the drawing, a leakage flow access side 54 is on the left, a leakage flow exit side 55 on the right.

Thus, a direction 58 of a differential pressure is pointing from left to right. The first component 11 comprises a first surface 12 with a first surface riffle 13. The second component 21 comprises a second surface 22 which is opposite to the first surface 12. Parallel to the first surface 12 is located the third surface 31, which is also comprised by the first component 11. The third surface 31 comprises a third surface riffle 32, which is opposite to a fourth surface 41. The fourth surface 41 is comprised by the second component 21.

An effect of the tenon on the leakage flow 53 is that the tenon acts as a barrier to the leakage flow 53. An effect of the first surface riffle 13 and the second surface riffle 32 is that they force the leakage flow 53 into a tortuous path. By these measures, the leakage flow is thus reduced highly efficiently.

Figure 5:
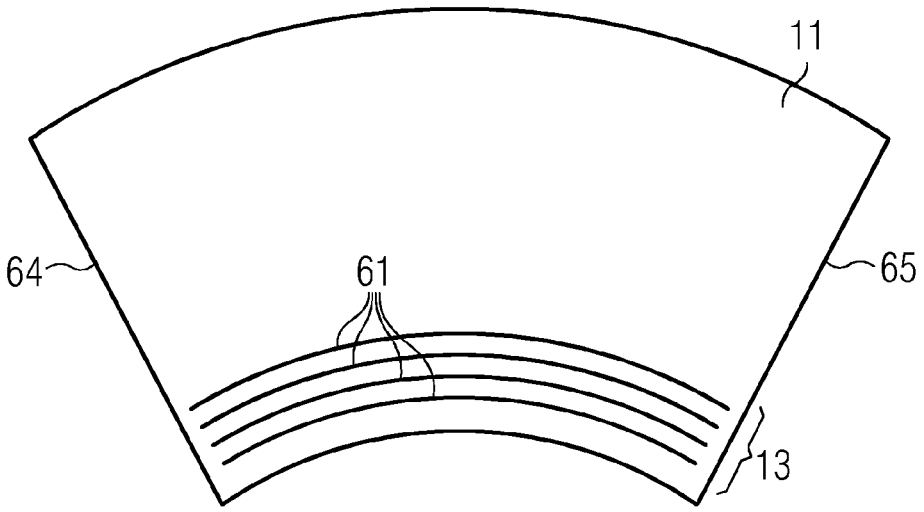
FIG. 5: shows a circumferential surface riffle.
Figure 6:
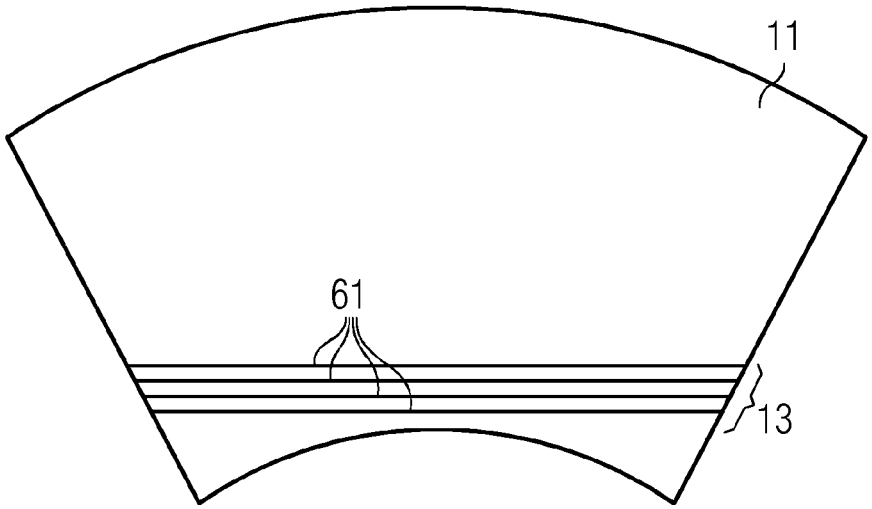
FIG. 6: shows a chordal surface riffle.

FIGS. 5 and 6 show embodiments of a surface riffle located on a surface in axial direction. In FIG. 5, a first surface riffle 13 on a first component 11 is shown. The first surface riffle 13 comprises four notches 61. Due to the curved shape of the notches 61, i.e. the curved shape of respective notch lengths, the first surface riffle 13 can be denoted as a circumferential surface riffle. Furthermore and in the shown example, it can be seen that the notches 61 stop shortly before a rim or edge of the first component 11. The reason for that is an avoidance of an extra leak path from a first side 64 of the first component 11 along a notch 61 to a second side 65 of the first component 11.

Finally, in FIG. 6, a first surface riffle 13 on a first component 11 is shown. The first surface riffle 13 comprises four notches 61. The notches 61 feature a shape of a straight line and can thus be denoted as a chordal surface riffle. An advantage of this shape is e.g. easing of manufacture.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A seal of a turbomachine for reducing a leakage flow through a fluid passage between a first component of the turbomachine and a second component of the turbomachine, the seal comprising the first component with a first surface and the second component with a second surface, wherein the first component is stiff with regard to a first force exerted perpendicularly to the first surface;

the second component is stiff with regard to a second force exerted perpendicularly to the second surface;

the first surface is opposite to the second surface; and the first surface comprises a first surface riffle, wherein the fluid passage is defined by the first and second components that are spaced apart, and wherein the first surface riffle is angled substantially perpendicularly to the leakage flow through the fluid passage.

2. The seal according to claim 1, wherein the first surface riffle comprises a plurality of notches.

3. The seal according to claim 2, wherein each notch has at least one of a depth, a width and a length that is optimized for reducing the leakage flow.

4. The seal according to claim 1, wherein the turbomachine comprises an axis of rotation and the first surface and the second surface are substantially extending radially from the axis of rotation or the first surface and the second surface are substantially extending parallel to the axis of rotation.

5. The seal according to claim 1, wherein the first component comprises a third surface and the second component comprises a fourth surface;

the third surface is opposite to the fourth surface; and the third surface comprises a third surface riffle and/or the fourth surface comprises a fourth surface riffle.

6. The seal according to claim 5, wherein the second surface is substantially parallel to the third surface and the fourth surface.

7. The seal according to claim 5, wherein the third surface and the fourth surface define boundaries of the fluid passage for the leakage flow.

8. The seal according to claim 1, wherein the seal further comprises a leakage flow access side, a leakage flow exit side and a seal strip with a horizontal seal strip extension and a vertical seal strip extension;

wherein a direction of a differential pressure between the leakage flow access side and the leakage flow exit side is substantially perpendicular to the horizontal seal strip extension.

9. The seal according to claim 1, wherein the first component is a rotatable part and/or a static part of the turbomachine, and the second component is a rotatable part and/or a static part of the turbomachine.

10. The seal according to claim 1, wherein the first component is a first part of a first turbine blade and the second component is a second part of the first turbine blade or the second part of a second turbine blade.

11. The seal according to claim 1, wherein the first component is a first part of a first stator vane and the second component is a second part of the first stator vane or the second part of a second stator vane.

12. A turbomachine comprising a seal according to claim 1, wherein the turbomachine is a gas turbine engine.

13. The turbomachine according to claim 12, wherein the seal is located in a turbine section of the turbomachine and/or in a compressor section of the turbomachine.

14. The seal according to claim 1, wherein the first surface and the second surface define boundaries of the fluid passage for the leakage flow.

15. A seal of a turbomachine for reducing a leakage flow between a first component of the turbomachine and a second component of the turbomachine, the seal comprising the first component with a first surface and a third surface and the second component with a second surface and a fourth surface, wherein the first component is stiff with regard to a first force exerted perpendicularly to the first surface;

the second component is stiff with regard to a second force exerted perpendicularly to the second surface;

the first surface is opposite to the second surface;

the first surface comprises a first surface riffle;

the third surface is opposite to the fourth surface; and the second surface comprises a second surface riffle, the third surface comprises a third surface riffle and/or the fourth surface comprises a fourth surface riffle, wherein the seal is configured such that the leakage flow is diverted by a diversion angle of greater than 135 degree, between the first surface riffle and the third surface riffle and/or between the first surface riffle and the fourth surface riffle.

16. The seal according to claim 15, wherein the seal is configured such that the leakage flow is diverted by a diversion angle of greater than substantially 180 degree, between the first surface riffle and the third surface riffle and/or between the first surface riffle and the fourth surface riffle.

17. A method of manufacturing a first component of a turbomachine with a reduced leakage flow between the first component and a second component of the turbomachine, the first component comprising a first surface and the second component comprising a second surface, the first surface being opposite to the second surface, particularly the first surface and the second surface defining boundaries of a fluid passage for the leakage flow;

the method comprising fabrication of a first surface riffle in the first surface, by grinding and/or by electrical discharge machining.

* * * * *